US005589106A

United States Patent [19]

Shim et al.

[11] Patent Number: 5,589,106

[45] Date of Patent: Dec. 31, 1996

[54] CARBON STEEL CORROSION INHIBITORS

[75] Inventors: Sang-Hea Shim, Naperville; Dennis P. Bakalik, Woodridge; Donald A. Johnson, Batavia; Bo Yang; Frank F. Lu, both of Naperville, all of Ill.

[73] Assignee: Nalco Chemical Company, Naperville, Ill.

[21] Appl. No.: 388,546

[22] Filed: Feb. 14, 1995

[51] Int. Cl.[6] ..... C23F 11/18; C23F 11/173

[52] U.S. Cl. ..... 252/387; 252/389.22; 252/389.23; 252/389.62; 252/392; 252/394; 252/391; 252/396; 422/15; 422/17; 422/18

[58] Field of Search ..... 210/696, 701, 210/764; 252/180, 181, 387, 389.22, 389.23, 391, 396, 389.62, 392, 394; 422/15, 17, 18

[56] References Cited

U.S. PATENT DOCUMENTS

| | | | |
|---|---|---|---|
| 451,826 | 8/1936 | Fritz | 210/696 |
| 3,308,062 | 3/1967 | Gunther | 210/698 |
| 3,589,859 | 6/1971 | Foroulis | 422/17 |
| 3,711,246 | 1/1973 | Foroulis | 422/17 |
| 4,237,090 | 12/1980 | DeMonbrun et al. | 422/13 |
| 4,490,308 | 12/1984 | Fong et al. | 562/106 |
| 4,546,156 | 10/1985 | Fong et al. | 526/240 |
| 4,566,973 | 1/1986 | Masler, III et al. | 210/701 |
| 4,595,517 | 6/1986 | Abadi | 252/82 |
| 4,604,431 | 8/1986 | Fong et al. | 525/329.8 |
| 4,680,399 | 7/1987 | Fong | 546/139 |
| 4,703,092 | 10/1987 | Fong | 525/351 |
| 4,752,443 | 6/1988 | Hoots et al. | 422/13 |
| 4,762,894 | 8/1988 | Fong et al. | 525/344 |
| 4,777,219 | 10/1988 | Fong | 525/329.4 |
| 4,801,388 | 1/1989 | Fong et al. | 210/701 |
| 4,898,686 | 2/1990 | Johnson et al. | 252/389.2 |
| 4,923,634 | 5/1990 | Hoots et al. | 252/389.2 |
| 4,929,425 | 5/1990 | Hoots et al. | 252/389.2 |
| 5,034,155 | 7/1991 | Soeder et al. | 252/389.23 |
| 5,035,806 | 7/1991 | Fong et al. | 210/701 |
| 5,120,797 | 6/1992 | Fong et al. | 525/329.4 |
| 5,179,173 | 1/1993 | Fong et al. | 525/329.4 |
| 5,259,985 | 11/1993 | Nakanishi et al. | 252/180 |

OTHER PUBLICATIONS

JP 62280381 (Dec. 5, 1987) as abstracted by Derwent AN No. 88-018071.

Huaxue Shijie (1990), vol. 31, No. 2 pp. 85–87 as abstracted by Chemical Abstract AN No. 1990:597522.

EP 140519 (May 8, 1985) as abstracted by Derwent AN No. 85-112069.

*Primary Examiner*—Sharon Gibson
*Assistant Examiner*—Valerie Fee
*Attorney, Agent, or Firm*—James J. Drake; Robert A. Miller

[57] ABSTRACT

The prevention of corrosion on the surfaces of metallic pipes, heat exchangers, and the like which are in contact with industrial cooling waters, and particularly industrial cooling waters containing low levels of hardness is controlled utilizing a corrosion inhibiting amount of a composition including an alkali metal silicate, a hydroxycarboxylic acid or its water soluble salts, an organophosphonate, and a water soluble polymer which acts as a dispersant. Superior corrosion inhibition is achieved using the compositions of this invention as corrosion inhibitors, particularly in cooling water systems employing mild steel metallurgy.

11 Claims, No Drawings

CARBON STEEL CORROSION INHIBITORS

BACKGROUND OF THE INVENTION

Corrosion occurring on the surfaces of metallic pipes, lines, heat exchangers and the like is undesirable. Corrosion shortens the life of equipment, impedes heat transfer efficiency, and corrosion byproducts may contribute to other problems in a particular system. Various methods have been tried to control corrosion occurring on the heat transfer surfaces, pipes, lines, and the like of equipment in contact with industrial waters.

Some of these methods have been to develop costly new metals that are resistant to corrosion such as the various stainless steel materials that are available, or the use of metal alloys which are less aggressively attacked by corrosion, such as admiralty. Other methods have employed the use of chemical treatment programs. These treatment programs have included such varied chemical substances such as for example, stabilized ortho-phosphates, polyphosphates, and the like which are thought to react with the surface of the metal being treated forming a protective film. Other chemical treatment programs which have been utilized in industrial cooling water systems include the use of certain heavy metal corrosion inhibitors such as compounds of molybdenum, chromium, and zinc. compounds.

Water soluble polymers such as polyacrylic acid have been utilized as additives to disperse solids contained in industrial cooling water systems and as an aid to prevent the adherence of scale on the metallic surfaces of such systems in contact with water. Likewise, microbiocides have been added to control the formation of microbiological growth in industrial systems. The presence of microbiological growth can provide a location where corrosion can occur, underneath the deposit and where water flow is minimal and untreated.

It is accordingly an object of this invention to provide to the art a novel, high performance chemical corrosion inhibition treatment program which can be used in industrial cooling water applications to help prevent the corrosion of the metal surfaces in contact with the water contained in such system. The corrosion inhibitors of this invention have been found to be particularly effective in preventing corrosion from occurring on the mild steel surfaces of industrial cooling water systems in contact with industrial cooling water.

SUMMARY OF THE INVENTION

This invention relates to a method for the prevention of corrosion on the metallic surfaces of industrial cooling water systems which are in contact with alkaline cooling waters. The method encompasses adding to the cooling water contained in such system a corrosion inhibiting amount of a multi-component composition comprising:

a. an alkali metal silicate;

b. a hydroxycarboxylic acid, or its alkali metal salts; and c. a water soluble dispersant polymer.

Other additives may be added to the composition depending on its intended use and application. For instance, a microbiocide may be added to control the growth of microorganisms in the system, or a yellow metal corrosion inhibitor such as tolyltriazole or benzotriazole may be added if yellow metal components are present in the cooling water system. Other additives, such as fluorescent dyes and organophosphonates, and the like may also be employed in conjunction with the application of the cooling water corrosion inhibitors of this invention to industrial cooling water system. One of the particular advantages of the corrosion inhibiting system described herein is that it is devoid of heavy metal components, and contains no phosphate component. As such, the treatment proposed herein may be considered more environmentally acceptable in certain areas than prior art treatment compositions containing either heavy metal components, and/or phosphate materials.

DESCRIPTION OF THE PREFERRED EMBODIMENTS

The composition of this invention contains sufficient amounts of each of the components to provide, when added to an industrial cooling water, a cooling water containing:

5–70 ppm by weight hydroxycarboxylic acid

10–100 ppm by weight of silicate (as sodium silicate), and,

0–50 ppm by weight of a water soluble polymeric dispersant.

In a preferred embodiment of the invention, the composition is added to an industrial cooling water system to provide from:

15–50 ppm by weight of hydroxycarboxylic acid;

15–75 ppm by weight of silicate (as sodium silicate); and

1–25 ppm by weight of a water soluble polymeric dispersant.

Optionally, and in a preferred mode of practicing this invention, the composition will comprise from 0.1–25, and preferably 1–10 ppm of a yellow metal corrosion inhibitor selected from the group of water soluble azoles including tolyltriazole and benzotriazole. In order to more fully explain this invention, each component will be addressed at length. Alternatively, the composition may comprise 2–20 ppm by weight of an organophosphonate.

The Hydroxycarboxylic acid

The hydroxycarboxylic acid component of the treatment program of the instant invention may be selected from the group consisting of gluconic acid, and other naturally derived polycarboxylic acids, as well as their water soluble salts. In the practice of this invention, gluconic acid and its sodium salt, sodium gluconate are particularly preferred hydroxycarboxylic acids. The use of gluconic acid and its alkali metal or ammonium salts as a corrosion inhibitor is taught in U.S. Pat. No. 3,711,246 to Forulis, the specification of which is hereinafter incorporated by reference into this application.

The Silicate

The water soluble silicate salts used in the present invention are the water soluble alkali metal silicates. These may be represented generically by the formula $Na_2O{\cdot}xSiO_2{\cdot}yH_2O$ where x is the range of about 1 to about 3.5. Commercial sodium silicate solutions in which the mole ratio of silica to soda is about 3.3 may be used to advantage. More alkaline solutions having an $SiO_2$:$Na_2O$ mole ratio as low as about 1:1 or less alkaline solutions having an $SiO_2$:$Na_2O$ mole ratio up to about 3.5:1 can also be used. Sodium silicate solutions are available commercially from any number of suppliers. Other alkali metal salts of silicate, especially potassium silicate may also be employed in the compositions and methods of this invention. Combinations of silicate and gluconate are known to inhibit corrosion as taught in U.S. Pat. No. 3,711,246 cited above.

The Biocide

In an alternative embodiment, a biocide may be added to the cooling water system in order to inhibit the formation of microbiological organisms which may lead to fouling of the system. Example 10 below compares the efficacy of a stabilized halogen biocide with various concentrations of the claimed composition. As may be seen by the example, no degradation in efficacy occurs for the biocide. In the preferred embodiment, the biocide comprises a stabilized halogen compound including stabilized bromides, fluorides and chlorides.

The Organophosphonate

The organophosphonate component of the subject invention may be selected from a wide variety of commercially available organophosphorous materials. Examples of organophosphonate materials which may find utility in the compositions and methods of the subject invention include those mentioned in the specification of U.S. Pat. No. 4,303,568,the specification of which is hereinafter incorporated by reference into this application. Representative organo-phosphonate compounds which may be used in the practice of this invention include amino-trimethylene phosphonic acid, 1-hydroxyethylidene 1,1-di phosphonic acid, hexamethylenetetramethylenephosphonic acid, phosphonobutanetricarboxylic acid, and the like. Any organophosphonate may be used in the practice of this invention so long as the material remains water soluble at room temperature or above, contains as least one active phosphonic acid group, and contains no objectionable heavy metal ions.

The Water Soluble Polymeric Dispersants

The water soluble polymeric dispersants useful in this invention can be chosen from a broad range of water soluble polymeric materials. Among the useful materials are water soluble polymers and copolymers of acrylic acid and its alkali metal and ammonium salts which have molecular weights ranging from several thousand to as much as 100,000. Other polymers which may be useful in the practice of this invention include those polymers of t-butyl acrylamide as disclosed in U.S. Pat. Nos. 4,566,973 and 4,744,949, the specifications of which are hereinafter incorporated by reference into this specification. A preferred polymeric material for use in the practice of this invention is an anionically charged polymer containing "mers" which may have the formula:

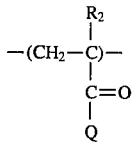

wherein Q is selected from the group consisting of—OY, wherein Y is H, alkali metal or ammonium, or the group:

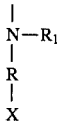

wherein "$R_2$" is hydrogen or methyl, "$R_1$" is hydrogen or alkyl and R is alkylene or phenylene, and "X" is sulfonate, phosphonate, (poly)hydroxyl, (poly)carboxyl or carbonyl and combinations thereof. Polymers of this structure, include polymers and copolymers of (meth)acrylic acid and its water soluble salts, as well as anionically modified or derivitized acrylamide polymers. The poly(meth)acrylic acid materials of this invention preferably will contain at least 20 weight percent acrylic or methacrylic acid or their respective water soluble alkali metal or ammonium salts, and preferably at least 50 weight percent acrylic or methacrylic acid. Most preferably, the poly(meth)acrylic acid materials when used as the dispersant polymer in this invention will contain greater than 75 weight percent (meth) acrylic acid or their respective water soluble alkali metal and ammonium salts. The derivitized acrylamide polymers which are useful as the dispersant polymers in this invention and their use as additives to industrial cooling water are more fully set forth in U.S. Pat. No. 4,923,634, the specification of which is hereinafter incorporated by reference into this specification. Known cooling water treatments containing polymers exemplified by this structure and methods of making such polymers include those disclosed in U.S. Pat. Nos. 4,604,431; 4,678,840; 4,680,339; 4,703,092; 4,752,443; 4,756,881; 4,762,894; 4,777,219; 4,801,388; 4,898,686; 4,923,634; 4,929,425; 5,035,806; 5,120,797; 5,143,622; and 5,179,173. Polymers having structures represented by the above formula include acrylic acid-acrylamide copolymers, and acrylic acid-acrylamide polymers which have been derivatized. Of particular interest are those polymers which have been derivatized to include sulfomethyl acrylamide. These polymers preferably have a molecular weight within the range of 7,000 to 100,000 and a mole ratio range of acrylic acid:acrylamide to 2-sulfomethylacrylamide(AMS) of from 13–95: 0–73: 5–41. A preferred composition within the same species would have a molecular weight within the range of 10,000 to about 50,000 and a mole ratio of acrylic acid: acrylamide: AMS of from 40–90: 0–50: 10–40. Other water soluble polymers useful in the practice of this subject invention are water soluble polymers prepared from anionic monomers such as those described in U.S. Pat. Nos. 4,490,308 and 4,546,156.

Other derivatized acrylamide-acrylic acid copolymers useful in this invention include those derivatized with species derivatives to include 2-sulfoethylacrylamide with a molecular weight of from 6,000 to 60,000 and a mole ratio within the range of acrylic acid (1–95), acylamide (0–54) and 2-sulfoethylacrylamide (10–40). A polymer containing sulfoethyl acrylamide and with a molecular weight in the range of 10,000 to 40,000 and a mole ratio of acrylic acid (40–90), acrylamide (0–50), and 2-sulfoethylacrylamide (10–40) is also thought to be useful in the practice of this invention.

The cooling systems to which the compositions of this invention are applicable include all typical once-through, and recirculating industrial cooling water systems. While useful in all systems, the compositions of this invention are advantageously employed in systems utilizing water containing relatively low levels of calcium and magnesium ions. Such waters are know to be particularly corrosive to metal surfaces in contact therewith, and the subject composition has been found to have exceptional corrosion prevention properties when used in such systems. As stated above, the compositions of this invention may also be advantageously employed in systems containing typical levels of hardness causing ions to control corrosion and scale formation.

EXAMPLES

In order to illustrate the efficacy of the compositions and method of the instant invention, the following examples were conducted.

Examples 1–4 were tested using Tafel analysis. Standard Tafel analysis was used to measure the corrosion rates of mild steel electrodes immersed in suitable cooling water. The experiments were run by a potentiostat controlled by a personal computer.

Mild steel cylinder electrodes were fabricated from a commercial ½ inch diameter AISI 1010 mild steel tube. The ½ inch length electrodes were polished by 600 grit emery paper and rinsed with acetone before each measurement. In general, the mild steel electrodes were rotated at 160 rpm by a rotator in a test solution to simulate industrial heat exchanger conditions (i.e.: metal surfaces under flow conditions). All of the test solutions contained 50 ppm CaCl2, 50 ppm MgSO4 and 100 ppm NaHCO3 as well as ppm of CaCO3. The solutions were heated to 50 C under aeration after inhibitors were added. The rotated carbon steel electrodes were then allowed to immerse in the test solution for an hour before Tafel measurements were conducted. The inhibitor combinations and measurement results are show in Table 1. The results show that the combination of gluconic acid, silicate, organic phosphonate and polymer inhibited mild steel by more than 95%.

TABLE I

| Example | Gluconic acid (ppm) | SiO3 ppm | PBTC[4] (ppm) | HEDP[1] (ppm) | Poly A[2] ppm | Poly B[3] ppm | Corr. rate (mpy) | Inhibition Efficiency |
|---|---|---|---|---|---|---|---|---|
| 1 | 0 | 0 | 0 | 0 | 0 | 0 | 11.63 | NA |
| 2 | 30 | 30 | 0 | 0 | 0 | 0 | 1.84 | 84.2 |
| 3 | 30 | 30 | 5 | 0 | 10 | 0 | 0.05 | 99.6 |
| 4 | 30 | 30 | 5 | 0 | 0 | 10 | 0.58 | 85.0 |
| 5 | 30 | 30 | 0 | 5 | 10 | 0 | 0.07 | 99.4 |
| 6 | 30 | 30 | 0 | 5 | 0 | 10 | 0.06 | 99.5 |

[1]Hydroxyethylidene-1,1-diphosphonic acid
[2]A Water soluble polyacrylic acid having a molecular weight of approximately 6,000
[3]A derivatized acrylamide-acrylic acid polymer containing 50–60 mole percent acrylic acid, 14–20 mole percent aminomethanesulfonate, with the balance acrylamide, and having a molecular weight of approximately 20,000
[4]Phosphonobutanetricarboxylic acid Tests were conducted using a pilot cooling tower of the type described by Reed and Nass in an article entitle "Small-Scale Short—Term Methods of Evaluating Cooling Water Treatments . . . Are they Worthwhile?" presented at the 36th annual meeting of the International Water Conference, Pittsburgh, Pa., Nov. 4–6, 1975. Pilot cooling tower tests were operated at 5–6 concentration cycles, a basin temperature of 100 F, a holding time index of 50–60 hours, a flow rate of 2 gallons per minute, and a pH value that was uncontrolled, depending on the natural pH of the waters being tested of 8.5–9.0.

The specific cooling water conditions and treatment dosages are listed in Table 2. The test results are shown in Table 3. At the beginning of pilot cooling tower test, the mass of each heat-exchange tube is determined. After the test is completed, the tubes are dried in an oven and reweighed. Next the tubes are cleaned with inhibited dilute Hcl and formaldehyde, dried, and the final weight determined. The three weights are used to determine rates of deposition (mg/day, cm2) and corrosion (mils per year). As the performance of the treatment increases, the deposit and corrosion rates decrease. Results are shown below.

Compositions were prepared which would provide the following concentrations of active ingredients in a recirculating water system.

TABLE 2

| | Treatment Dosages for Pilot Cooling Tower Tests | | | | | |
|---|---|---|---|---|---|---|
| Example | Gluconate (ppm) | Silicate (ppm) | HEDP[1] (ppm) | Polymer "A"[2] (ppm) | Polymer "B"[3] (ppm) | TT[4] (ppm) |
| 1 | 30 | 30 | 5 | 10 | | 2 |
| 2 | 40 | 40 | 6 | 13 | | 2.5 |
| 3 | 40 | 40 | 6 | | 13 | 2.5 |
| 4 | 40 | 40 | 6 | | 13 | 2.5 |

[1]Hydroxyethylidene-1,1-diphosphonic acid
[2]A water soluble polyacrylic acid having a molecular weight of approximately 6,000 (Hereinafter "Poly A")
[3]A derivatized acrylamide-acrylic acid polymer containing 50–60 mole percent acrylic acid, 14–20 mole percent aminomethanesulfonate, with the balance acrylamide, and having a molecular weight of approximately 20,000 (Hereinafter Poly B)
[4]Tolyltriazole

TABLE 3

| Cooling Water Conditions for Pilot Cooling Tower Tests | | | | | | |
|---|---|---|---|---|---|---|
| Example | $Ca^{++}$ (ppm) | $Mg^{++}$ (ppm) | $SiO_3^-$ (ppm) | $SO_4^-$ (ppm) | $Cl_2^-$ (ppm) | M alkalinity |
| 1 | 75 | 30 | 0 | 40 | 80 | 300 |
| 2 | 165 | 80 | 0 | 60 | 125 | 300 |
| 3 | 265 | 80 | 0 | 60 | 125 | 300 |
| 4 | 125 | 60 | 85 | 60 | 500 | 300 |

Shows desired level. Actual averages were +−10% of desired level. All ppm values are expressed as ppm $CaCO_3$

TABLE 4

| Pilot Cooling Tower Test Results | | |
|---|---|---|
| Example | Corrosion - mild steel (mpy) | Deposit-Mild Steel (mg/day · $cm^2$) |
| 1 | 0.3 | 0.02 |
| 2 | 0.9 | 0.07 |
| 3 | 0.4 | 0.02 |
| 4 | 0.1 | 0.01 |

Results indicate the suprising effect of the four major ingredients of the subject invention in the control of corrosion and scale.

EXAMPLE 5

Table 5 shows the influence of calcium concentration on corrosion rates observed with two treatments.

TABLE 5

| | Corosion Rate (mpy @ Ca conc) | | |
|---|---|---|---|
| Treatment | 50 | 200 | 400 |
| Treatment A | 1.84 | 5.3 | 18.3 |
| Treatment B | .06 | .59 | 4.7 |
| Treatment A gluconate (30), silicate (30) | | | |
| Treatment B gluconate (30), silicate (30), HEDP (10), Poly B | | | |

Treatment A consists of the mixture of gluconate and silicate. It is easily seen that the influence of calcium in the test water has a profound affect on the corrosion rate observed with this treatment. In fact, the corrosion rate observed at 400 ppm calcium (18.3 mpy) is alarmingly high and points out one of the serious deficiencies of the treatment described by the prior art. It would not be uncommon for naturally occurring hardness ions to present calcium concentrations in excess of 200 ppm in a cooling water system. In contrast, it can be readily seen that the treatment (Treatment B) described in this invention to be far less affected by the presence of hardness ions in the water. In fact, the performance at 200 ppm calcium is of particular note. The treatment of this invention offers corrosion rates which are lower by a factor of 10 times (0.59 versus 5.3) over the treatment described by previous teachings. This is an unexpectedly low corrosion rate and represents an improvement over the previous teachings which offers significant practical benefits.

EXAMPLE 6

Table 6 shows the corrosion rates obtained in water containing 50 ppm calcium and HEDP or polyacrylic acid alone. It can be readily seen that the corrosion inhibition efficiency of the phosphonate

TABLE 6

| Treatment | Corrosion Rate (MPY) | Efficiency |
|---|---|---|
| HEDP (5 ppm) | 9.1 | 21.7 |
| Poly A (10 ppm) | 17.6 | −51.3 |

or Poly A alone is poor and would not constitute corrosion protection for mild steel. In fact, the polymer acting alone accelerates the corrosion rate for mild steel when compared to the blank. It is therefore completely unexpected that the inclusion of these agents with hydroxy acid and silicate would so markedly improve the corrosion performance of the mixture.

EXAMPLE 7

It has been recognized for some time in corrosion science, that low flow and stagnant water conditions represent a particularly corrosive environment for mild steel. The fact that treatment agents become depleted at the metal surface in low flow regions, contributes to the poor performance of most traditional treatments under these conditions. Table 7 illustrates the unacceptably poor performance of the agents tartrate and silicate when combined and tested under stagnant flow conditions. In marked contrast to the unacceptably high corrosion rates observed with these agents, is the performance of the treatment described in the instant invention.

TABLE 7

| Treatment | Corrosion Rate |
|---|---|
| Treatment A | 8.5 |
| Treatment B | .05 |
| Treatment A tartrate (30), silicate (30) | |
| Treatment B tartrate (30), silicate (30), HEDP (5), Poly B (10) | |

Treatment B shows remarkably low corrosion under these severe operating conditions.

The performance demonstrated in this example is of major practical importance in cooling water and boiler systems. Corrosion in stagnant, low flow areas of piping is of serious concern in these systems. In addition, there are many recirculating cooling systems which operate on an intermittent basis. Numerous such systems, especially confort cooling systems, exhibit widely variable demands for cooling. In fact, such systems have periodic shutdown periods as a part of normal operating procedures producing the highly corrosive situation described and demonstrated in Table 7. It is for these reasons that the result reported in Table 7 is deemed to be of major significance.

EXAMPLE 8

The corrosion rate obtained with a treatment consisting of tartrate, silicate and Poly B is shown in Table 8. The corrosion rate observed in this system is 0.1 mpy and represents a significant improvement over the treatment described by prior art (1.84 mpy). This result is of considerable significance for environmental reasons. The phosphorus content of a treatment program is of concern in some geographical areas since treatment is normally discharged to the environment during normal blowdown of cooling towers. While the principal concern for discharge of phosphorus materials is related to inorganic phosphate content, concern also exists for total phosphorus content of a treatment program. The results shown in Example 8 indicate that excellent corrosion protection can be achieved with a nonphosphorus containing treatment program. While the preferred treatment the instant invention contains one of the several phosphonates described in Example 8, acceptable performance can be achieved with the component treatment described above.

TABLE 8

| Treatment | Corrosion Rate |
|---|---|
| Blank | 11.63 |
| Treatment C | 0.1 |
| Treatment C tartrate (30), silicate (30), Poly B (10) | |

EXAMPLE 9

A comparison of the independent effects of various components of the claimed composition was made. Table 9 below compares the corrosion rates of several different combinations of water soluble silicate salts, water soluble polymeric dispersants and organophosphonates in both hard and soft water silicate conditions. Hard water conditions may be defined as those where the ratio of sodium oxide to silicate is 3:1 or greater. Soft water conditions are those where the ratio of sodium oxide to silicate is 1:1 or less. As can be seen, the results are comparable, inicating that the effects are independent of the individual type of compound being used. Rather, as claimed in the invention, the combination of elements in the claimed composition is the factor which produces the desired effect.

TABLE 9

| Corrosion Rate | Sample | Silicate | Phosphonate | Hardness | Polymer |
|---|---|---|---|---|---|
| .23 | 1 | glyconic | BEDP | HARD | POLY B |
| .06 | 2 | tanafic | PBTC | SOFT | POLY A |
| .01 | 3 | mucic | AW | HARD | POLY B |
| .006 | 4 | saccharic | B575[1] | HARD | POLY B |
| .08 | 5 | citric | HEDP | SOFT | POLY B |
| .08 | 6 | gluconic | PBTC | HARD | POLY B |
| .04 | 7 | gluconic | AMP | SOFT | POLY C[2] |
| .07 | 8 | gluconic | B575 | SOFT | POLY D[3] |

[1]B575 is BELCOR ® 575 manufactured by FMC Corporation.
[2]POLY C is an acrylic acid/ANTS copolymer that is manufactured as ACUMER ® 2000 by Rohm & Haas.
[3]POLY D is a polymer manufactured by B.F. Goodrich as KXP-70.

Having thus described our invention, we claim:

EXAMPLE 10

In an alternative embodiment of the invention, a biocide is added to the cooling water system. Preferably, the biocide is a stabilized halogen such as bromides, fluorides and chlorides. As shown in Tabe 10 and Table 11 below, the chloride remains stable under the claimed corrosion inhibitor dosages.

TABLE 10

Stability of Gluconate in 200 ppm $NaHCO_3$ (pH = 8.8)

| ID | NaOCl Treatment | Contact Time | Gluconic Acid (ppm) |
|---|---|---|---|
| | Solution initially contained: 20.0 ppm gluconic acid | | |
| 1 | Blank (0.0 ppm) | — | 20.0 |
| 2 | 100 ppm (from N2818) slug | 18 h | 20.0 |
| 3 | 200 ppm (from N2818) slug | 24 h | 18.6 |
| 4 | 200 ppm slug dose | 22 h | 2.1 |

TABLE 10-continued

Stability of Gluconate in 200 ppm $NaHCO_3$ (pH = 8.8)

| ID | NaOCl Treatment | Contact Time | Gluconic Acid (ppm) |
|---|---|---|---|
| | Solution initially contained: 50.0 ppm gluconic acid (pH = 8.5~8.8) | | |
| 1 | Blank (0.0 ppm) | — | 50.0 |
| 2 | 1 ppm slug dose | 90 h | 49.4 |
| 3 | 1 ppm + 2 × 0.5 ppm slug | 92 h | 49.1 |
| 4 | 1 ppm + 10 × 0.5 ppm slug | 20 min~94 h | 48.0 |
| 4* | 1 ppm + 18 × 0.5 ppm slug | 1.5 h~120 h | 46.9 |
| 5 | 1 ppm + 18 × 0.5 ppm slug | 1.5 h~120 h | 46.9 |
| 6 | 20 × 0.5 ppm slug | 3.5 h~122 h | 46.5 |
| 2* | 1 ppm + 10 ppm slug | 16 h | 47.5 |
| 3* | 1 ppm + 2 × 0.5 ppm + 20 ppm | 16 h | 45.1 |

TABLE 11

Stability of Gluconate in 360 ppm Ca/200 ppm Mg/200 ppm $NaHCO_3$ + 10 ppm PR 4117 active (pH = 8.97) water (Note: solution initially contained 20.0 ppm gluconic acid)

| ID | NaOCl Treatment | Gluconic Acid (ppm) |
|---|---|---|
| | contact time: 5 days | |
| 1 | 0.0 (blank) | 20.0 |
| 2 | 20 ppm slug dose | 18.6 |
| 3 | 40 ppm slug dose | 16.5 |
| 4 | 20 ppm (from N2818) slug dose | 20.0 |
| 5 | 40 ppm (from N2818) slug dose | 19.7 |
| | PCT G3240 0.1~0.3 ppm Free NaOCl from N2818 Gluconic acid theoretical feed: 50 ppm (start: 75 ppm) | |
| | 12-7-94 (test start) | 75.3 |
| | 12-8-94 (no blowdown yet) | 70.2 (<$10^2$ cfu/ml) |
| | 12-13-94 | (1.6 × $10^3$ cfu/ml) |
| | 12-16-94 | 47.2 |
| | 12-19-94 | (4.0 × $10^3$ cfu/ml) |
| | 12-20-94 | 44.9 |

We claim:

1. A method for the control of corrosion and scale on the mild steel surfaces of an industrial cooling water system which comprises maintaining in the cooling water system:

a. 5–70 ppm by weight hydroxycarboxylic acid;

b. 10–100 ppm by weight of a water soluble silicate salt; and c. 0–50 ppm by weight of a water soluble polymeric dispersant having the formula:.

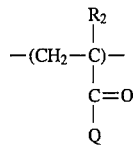

wherein Q is selected from the group consisting of OY, wherein Y is H, alkali metal or ammonium, or the group:

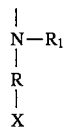

wherein "$R_2$" is hydrogen or methyl, "$R_1$" is hydrogen or alkyl and R is alkylene or phenylene, and "X" is sulfonate, phosphonate(poly)hydroxyl, (poly)carboxyl or carbonyl and combinations thereof, said polymer having a molecular weight of from 7,000–100,000.

2. The method of claim 1 wherein the hydroxycarboxylic acid is selected from the group consisting of gluconic acid and its water soluble alkali metal and ammonium salts.

3. The method of claim 1 further comprising maintaining in the cooling water system 1–50 ppm by weight of a water soluble organophosphonate.

4. The method of claim 1 wherein the water soluble silicate salt is sodium silicate.

5. The method of claim 1 wherein the water soluble polymeric dispersant is a copolymer of acrylic acid and acrylamide having a molecular weight of about 20,000.

6. The method of claim 1 wherein Q is the formula:

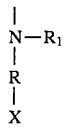

$R_2$ is H, R and $R_1$ are $CH_3$, and X is sulfonate.

7. The method of claim 3 wherein from 15–50 ppm by weight of gluconic acid or its water soluble salts, from 15–75 ppm by weight of sodium silicate, from 2–20 ppm by weight of the organophosphonate; and 1–25 ppm by weight of the water soluble polymeric dispersant are maintained in the cooling water system.

8. The method of claim 1 wherein from 0.1–25 ppm of a yellow metal corrosion inhibitor from the group consisting of tolyltriazole and benzotriazole is added to the cooling water system.

9. The method of claim 7 wherein from 0.1–25 ppm of a yellow metal corrosion inhibitor from the group consisting of tolyltriazole and benzotriazole is added to the cooling water system.

10. The method of claim 3 wherein the organophosphonate is selected from the group consisting of: amino-trimethylene phosphonic acid, 1-hydroxyethylidene 1,1-diphosphonic acid, hexamethylenetetramethylenephosphonic acid, and phosphonobutanetricarboxylic acid.

11. The method of claim 1, further comprising the step of adding a biocide which is a stabilized halogen.

* * * * *